US010153531B2

(12) United States Patent
Chayat

(10) Patent No.: US 10,153,531 B2
(45) Date of Patent: Dec. 11, 2018

(54) MULTILAYER MICROWAVE FILTER

(71) Applicant: VAYYAR IMAGING LTD., Yehud (IL)

(72) Inventor: Naftali Chayat, Kfar Saba (IL)

(73) Assignee: VAYYAR IMAGING LTD., Yehud (IL)

( * ) Notice: Subject to any disclaimer, the term of this patent is extended or adjusted under 35 U.S.C. 154(b) by 2 days.

(21) Appl. No.: 15/258,222

(22) Filed: Sep. 7, 2016

(65) Prior Publication Data

US 2017/0069943 A1 Mar. 9, 2017

Related U.S. Application Data

(60) Provisional application No. 62/215,090, filed on Sep. 7, 2015.

(51) Int. Cl.

| | |
|---|---|
| ***H01P 1/203*** | (2006.01) |
| ***H01P 3/08*** | (2006.01) |
| ***H01P 5/12*** | (2006.01) |

(52) U.S. Cl.

CPC ..... *H01P 1/20345* (2013.01); *H01P 3/082* (2013.01); *H01P 3/088* (2013.01); *H01P 5/12* (2013.01)

(58) Field of Classification Search

CPC .. H01P 3/08; H01P 3/088; H01P 3/082; H01P 7/08; H01P 7/086; H01P 1/2013; H01P 1/203; H01P 1/20345; H03H 2001/0085

USPC ..... 333/185, 208

See application file for complete search history.

(56) References Cited

U.S. PATENT DOCUMENTS

| | | | | |
|---|---|---|---|---|
| 5,406,235 | A * | 4/1995 | Hayashi | H01P 1/203 333/202 |
| 5,621,366 | A * | 4/1997 | Gu | H01P 7/084 333/185 |
| 6,242,992 | B1 * | 6/2001 | Lakin | H01P 3/003 333/219 |
| 2002/0102835 | A1 * | 8/2002 | Stucchi | H01L 21/76877 438/618 |
| 2007/0120628 | A1 * | 5/2007 | Jun | H01P 1/2088 333/208 |
| 2016/0072167 | A1 * | 3/2016 | Kawai | H02J 50/70 333/24 R |

OTHER PUBLICATIONS

Matsuo et al.; "Dual-Mode Stepped-Impedance Ring Resonator for Bandpass Filter Applications"; Jul. 2001.*

* cited by examiner

*Primary Examiner* — Rakesh Patel
(74) *Attorney, Agent, or Firm* — Browdy and Niemark, PLLC

(57) ABSTRACT

A radio frequency filters and methods for implementing the filters in multilayer metallic-dielectric structures, such as printed circuit boards (PCB), low temperature co-fired ceramic (LTCC) components and integrated circuits (IC). The methods and filters utilize vertical stacking of transmission lines and related frequency-selective structures to obtain compact implementation of filters of high order. The methods and filters are applicable to a variety of filter types and related structures such as multiplexers.

10 Claims, 14 Drawing Sheets

MULTILAYER MICROWAVE FILTER

CROSS-REFERENCE

The present application claims the benefit of U.S. Provisional Application Ser. No. 62/215,090, filed on Sep. 7, 2015, entitled "MULTILAYER MICROWAVE FILTER", the entire disclosures of which are incorporated herein by reference.

INCORPORATION BY REFERENCE

All publications, patents, and patent applications mentioned in this specification are herein incorporated by reference to the same extent as if each individual publication, patent, or patent application was specifically and individually indicated to be incorporated by reference.

FIELD OF THE INVENTION

The present invention relates to a microwave or radio frequency filters and related devices such as multiplexers, and in particular to providing devices with a layer-efficient and area-efficient use of multilayer circuits for implementing such filters and devices.

BACKGROUND OF THE INVENTION

Prior to setting forth the background of the invention, it may be helpful to set forth definitions of certain terms that will be used hereinafter.

The term 'Microstrip' as used herein is defined as a type of electrical transmission line which can be fabricated using for example printed circuit board technology, and is used to convey microwave-frequency signals. It consists of a conducting strip separated from a ground plane by a dielectric layer known as the substrate.

The term 'Stripline' as used herein is defined as a transverse electromagnetic (TEM) transmission line medium. A stripline circuit uses a flat strip of metal which is sandwiched between two parallel ground planes. The insulating material of the substrate forms a dielectric substrate. The width of the strip, the thickness of the substrate and the relative permittivity of the substrate determine the characteristic impedance of the strip which is a transmission line.

Filtering radio frequency signals is a fundamental need in radio frequency and microwave systems. The most common filters in the microwave range are bandpass filters, which pass a specific range of frequencies, and attenuate the signals at lower or higher frequencies. Design of microwave filters is commonly implemented using "resonators" and coupling structures, which control the signal passage between the resonators. In most basic structures the resonators form a chain and only the adjacent resonators are coupled. In more advanced structures coupling between nonadjacent resonators is added, to introduce nulls in the rejection bands.

There are numerous techniques of implementing resonators, such as cavities and transmission line segments (e.g. ½ wavelength for open-open lines and ¼ wavelength for shorted-open lines). The resonators can be reduced in size by use of dielectric materials, such as using ceramic materials or printed circuit substrates. Transmission line structures can be further shortened by using stepped-impedance resonators, which emulate lumped L-C structures. Folding the resonators, such as in "hairpin" filters is possible. These typical resonator structures are exemplified in FIG. 1. In FIG. 1*a* a resonator is shown comprising a quarterwave transmission line 100 connected to ground at one end 101 and left open at the other end 102. FIG. 1*b* shows a shortened (less than quarterwave) resonator in which the open end 102 is further loaded by a capacitor to the ground. FIG. 1*c* shows a halfwave resonator in which the transmission line 100 is shorted to ground at both ends 101*a*, 101*b*, while FIG. 1*d* shows a halfwave resonator in which the transmission line 100 is open at both ends 102*a*, 102*b*. FIG. 1*e* shows a stepped impedance resonator, comprising a grounded high-impedance (inductive) section 100*a* and an open low impedance (capacitive) section 100*b*. FIG. 1*f* shows a stepped-impedance equivalent of a halfwave transmission line open at both ends. FIG. 1*g* illustrates a hairpin resonator, where folding is utilized do reduce the physical extent of the resonator, while FIG. 1*h* shows a further folded hairpin structure.

Let us briefly review the main transmission line structures applicable to printed circuit technology. The most popular structure is the "microstrip" structure, the cross section of which is illustrated in FIG. 2*a*, in accordance with the prior art. The signal line 200 is situated at the outermost (top or bottom) side of a printed circuit, with a dielectric substrate 202 separating between the signal line and the ground plane 201. Another popular structure, "stripline", is shown in FIG. 2*b*. In this case the signal line 200 is surrounded on both of its sides by dielectric material 202 and groundplanes 201*a*, 201*b*. The stripline structure is inherently shielded by its groundplanes. FIG. 2*c* shows another popular structure, a coplanar waveguide (CPW). In this structure the signal line 200 and the ground conductors 204 are all situated on the same metal layer 205 of the printed circuit. In the CPW structure the fields are primarily confined to the gap between the signal line 200 and the groundplane conductors 204. Practically, the CPW structure is supported by the dielectric structure of the printed circuit. CPW structure has variants combining it with groundplanes. In FIG. 2*d* a CPW with a single groundplane 201 is shown, being a hybrid of a CPW and a microstrip. In FIG. 2*e* a CPW with two groundplanes 201 is shown, being a hybrid of a CPW and a stripline. Finally, FIG. 2*f* shows an example of a multilayer printed circuit board (PCB) incorporating multiple transmission line structures by stacking them in the vertical domain. The line in the uppermost layer is a grounded CPW, followed by a stripline, followed by a doubly-grounded CPW, ending with a microstrip at the bottom layer. Several observations are appropriate here. First, the groundplanes 201 shield between the different transmission lines, creating thus very high isolation between signals at the different layers. Another feature is the metallic sidewalls 203, which equalize the potential between the groundplanes and prevent the formation of signals between the groundplanes, which act as a parallel-plate TEM waveguide. The sidewalls 203 are typically implemented as multiple consecutive "vias" (metallic posts interconnecting layers in the PCBs).

Inter-resonator coupling structures are equally diverse. Cavity resonators are often coupled by slots in the inter-cavity walls. Transmission line resonators are often coupled by predominantly inductive (current based, such as proximity between ends shorted to ground), predominantly capacitive (voltage based, such as proximity between open ends), or distributed coupling (such as parallel ¼ wavelength sections). FIG. 3 exemplifies common cases according to the prior art of coupling between transmission line resonator structures. FIG. 3*a* shows the case of primarily inductive coupling between the shorted ends of quarterwave resonators. FIG. 3*b* exemplifies capacitive coupling along transmission lines near their open ends. FIG. 3*c* shows capacitive coupling between open ends of transmission lines. FIG. 3*d* illustrates primarily magnetic coupling between the high-impedance sections of stepped impedance resonators, while FIG. 3*e* shows a capacitive coupling between the low-impedance line sections of stepped impedance resonators.

Let us address the embodiment of coupled transmission lines in physical structures according to the prior art. FIG. 4 addresses various cases of printed circuit transmission lines. FIG. 4*a* shows side-coupled microstrip lines. FIGS. 4*b* and 4*c* show coupling between stripline transmission lines—FIG. 4*b* illustrates side coupled lines, used for low-to-medium coupling, while 4*c* illustrates broadside-coupled lines, typically used for medium-to-high coupling factors.

For narrowband low-loss filters air-filled resonators are common. For medium bandwidth, low-loss, high dielectric constant dielectric materials are used. For medium bandwidth and above printed circuit techniques are commonly used. Microstrip transmission lines are popular, and many microstrip PCB filter structures were developed. The resonators are commonly placed side by side for coupling. "Stripline" resonators, in which the transmission line is sandwiched between groundplanes, are also used. In this case, the lines are coupled by lateral proximity, or by partial overlap between resonators in adjacent layers ("broadside coupling").

Multilayer printed circuit board technology is well developed and is suitable for mass production. Another well-developed multilayer circuit technology suitable for filter production is ceramic technology, such as LTCC (low temperature co-fired ceramics). The number of layers used relates directly to manufacturing cost.

Multilayer stripline circuits with multiple ground planes are well known, including uses for filter applications. An example of such structure is described in U.S. Pat. No. 7,755,457 (to Harris), where ground layers alternate with signal carrying layers. The signal carrying layers then contain the resonant structures needed to perform the filtering functions. The signals are conveyed from the outermost layer to inner layers using via pins.

In U.S. Pat. No. 5,719,539 (to Matsushita Electric Company) multilayer filter structures are described. In some embodiments of this patent, the layers are divided into ground layers, resonator layers and coupling capacitor layers. In some embodiments resonators are coupled through slots in groundplanes separating the resonators. In other embodiments stripline resonators in adjacent layers are provided, sharing common groundplanes which are coupled by overlap between the resonators.

It is stressed that the numbering of elements within the Figures attempts to use same numbers for similar functional elements across the drawings, according to the following list:

100—transmission line (TL)
101—grounded end of a transmission line
102—open end of a transmission line
200—signal strip
201—ground layer
202—dielectric layer
203—vertical interconnect between layers
204—ground strip in a CPW layer
205—coplanar waveguide (CPW) layer
300—a multilayer filter (MLF)
310—a layer within a multilayer filter
320—a stepped impedance resonator (SIR) in a MLF
330—inductive section of a SIR
340—capacitive section of a SIR
350—in/out feed lines of the MLF
400—filter response

SUMMARY OF INVENTION

The present invention relates to radio frequency filters and related structures, such as diplexers, multiplexers, implemented with multilayer metallic-dielectric structures, such as multilayer printed circuit boards (PCB), low-temperature co-fired ceramics (LTCC) structures, and integrated circuits.

Specifically radio frequency filters and methods are provided for implementing the filters in multilayer metallic-dielectric structures, such as printed circuit boards (PCB), low temperature co-fired ceramic (LTCC) components and integrated circuits (IC). The methods and filters utilize vertical stacking of transmission lines and related frequency-selective structures to obtain compact implementation of filters of high order. The methods and filters are applicable to a variety of filter types and related structures such as multiplexers.

According to a first aspect of some embodiments, there is provided a filter, comprising: a plurality of conducting layers, and a plurality of frequency selective components, wherein each conducting layer of at least two layers of said plurality of conducting layers comprises: at least one frequency selective component and a groundplane, wherein said groundplane surrounding said at least one frequency selective component, and wherein the at least one frequency selective component in a first layer and the at least one frequency selective component in a second layer of the at least two layers overlap with one another.

In an embodiment, the structure of said at least one frequency selective component is selected from the group comprising of: stripline, microstrip or coplanar waveguide.

In an embodiment, the structure of said plurality of conducting layers is selected from the group consisting of: a printed circuit structure, ceramic structure, LTCC (low temperature co-fired ceramics) structure, integrated circuit structure.

In an embodiment, said at least one frequency selective component is a stepped impedance resonator.

In an embodiment, the at least two frequency selective components of said plurality of frequency selective components in adjacent layers are predominantly magnetically coupled by proximity between the two frequency selective components shorted to ground, or predominantly capacitively coupled between open ends of the two frequency selective components.

In an embodiment, at least one the said plurality of frequency selective components is selected from the group consisting of: transmission lines, capacitive plates, radial stubs, transmission line resonators.

In an embodiment, the groundplanes of said at least two layers are interconnected by multiple through vias surrounding the frequency selective components.

In an embodiment, the filter comprising a first port, said first port is placed at first layer of said plurality of layers, and a second port placed in a second layer.

In an embodiment, said first layer is an outermost layer.

In an embodiment, said second layer is an outermost layer on the side opposite of the first outermost layer.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

The subject matter disclosed may best be understood by reference to the following detailed description when read with the accompanying drawings in which.

DETAILED DESCRIPTION

Figure 1A:
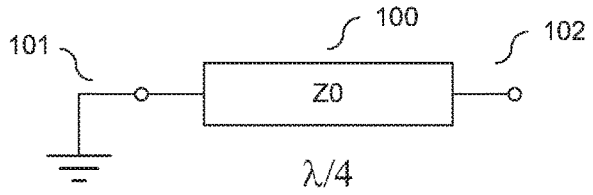
Fig. 1a (Prior Art)
FIGS. 1*a*-1*h* illustrate various resonator structures, according to the prior art.
Figure 1B:
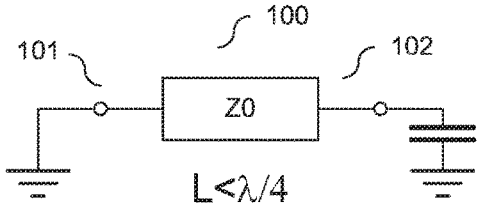
Fig. 1b (Prior Art)
Figure 1C:
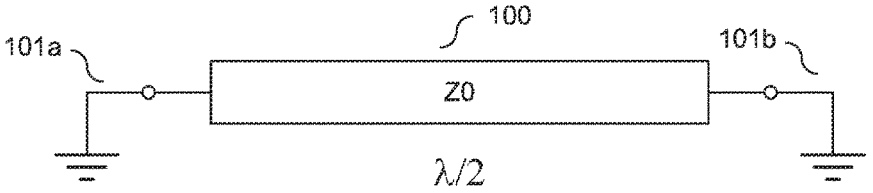
Fig. 1c (Prior Art)
Figure 1D:
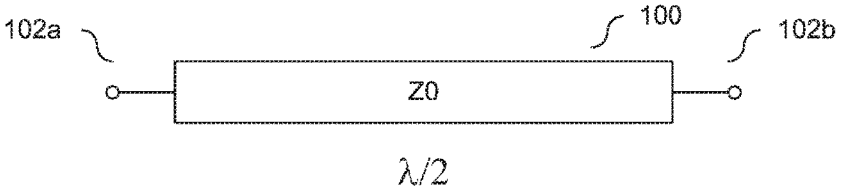
Fig. 1d (Prior Art)
Figure 1E:
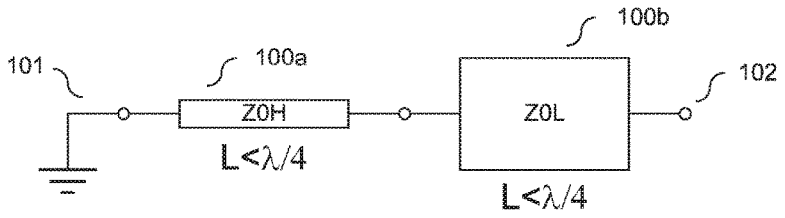
Fig. 1e (Prior Art)
Figure 1F:
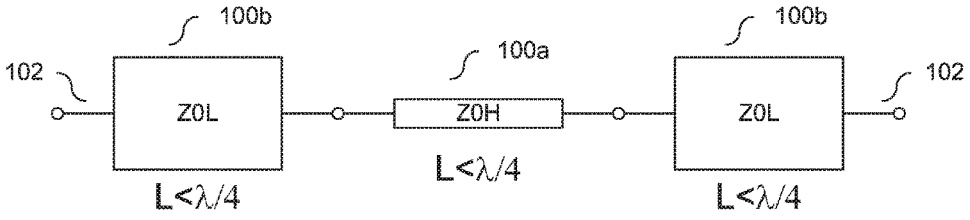
Fig. 1f (Prior Art)
Figure 1G:
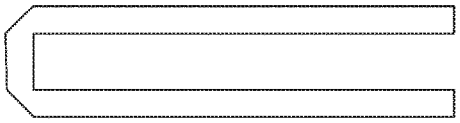
Fig. 1g (Prior Art)
Figure 1H:
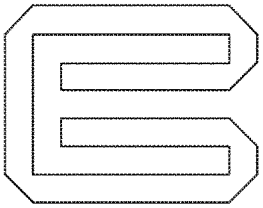
Fig. 1h (Prior Art)
Figure 2A:
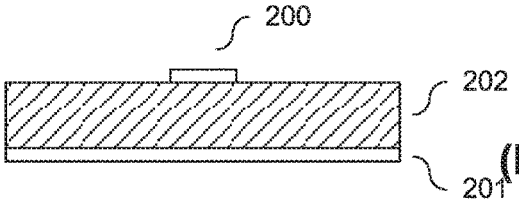
Fig 2a (Prior Art)
FIGS. 2*a*-2*f* illustrate transmission line types customary with printed circuit and other multilayer technologies, according to the prior art.
Figure 2B:
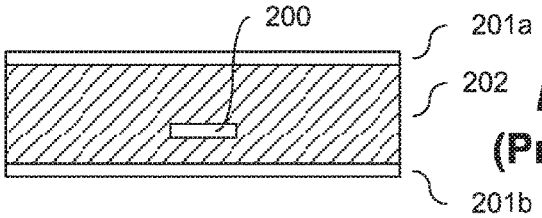
Fig 2b (Prior Art)
Figure 2C:
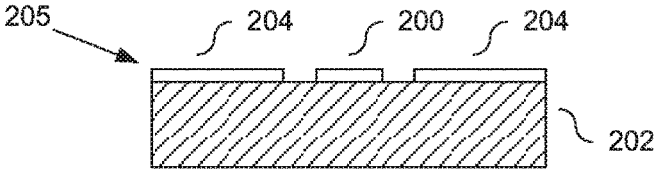
Fig 2c (Prior Art)
Figure 2D:
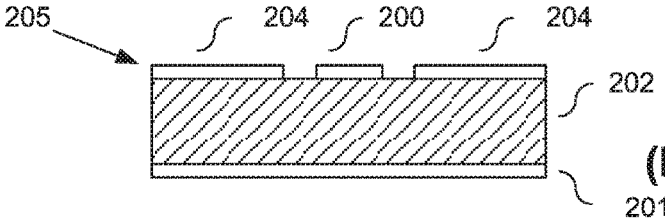
Fig 2d (Prior Art)
Figure 2E:
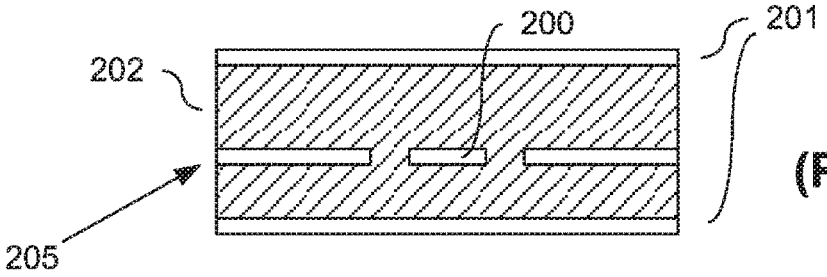
Fig. 2e (Prior Art)
Figure 2F:
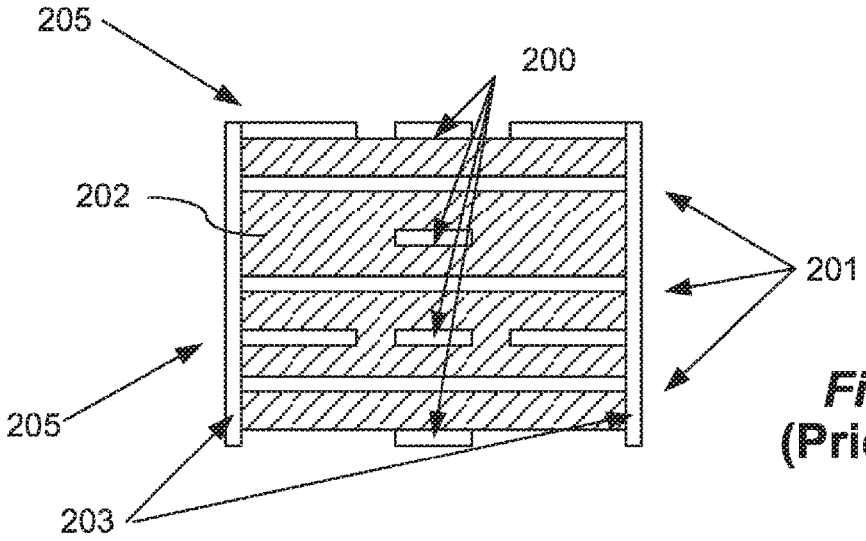
Fig. 2f (Prior Art)
Figure 3A:
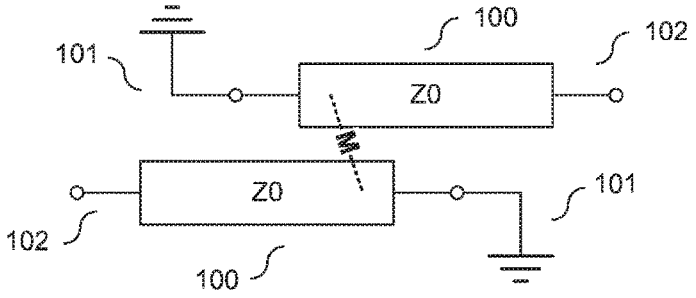
Fig. 3a (Prior Art)
FIGS. 3*a*-3*e* illustrate examples of types of coupling between transmission line structures, according to the prior art.
Figure 3B:
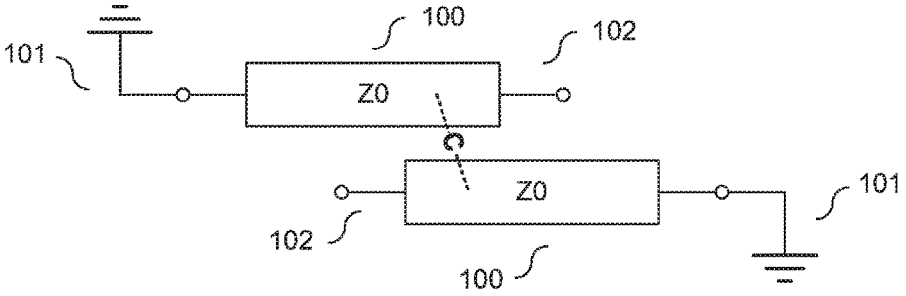
Fig. 3b (Prior Art)
Figure 3C:
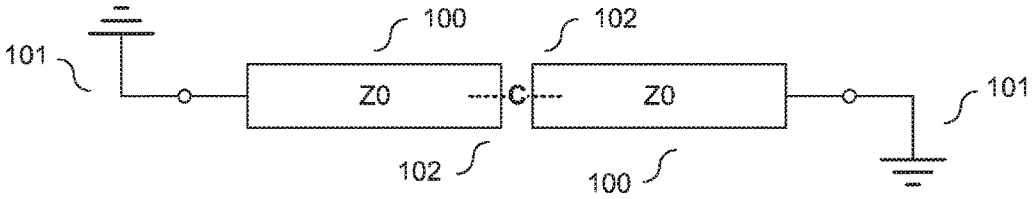
Fig. 3c (Prior Art)
Figure 3D:
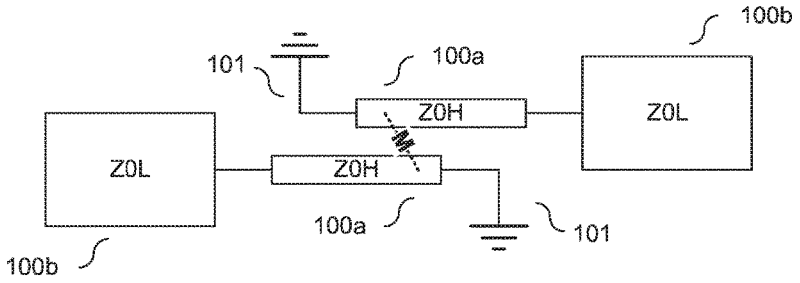
Fig. 3d (Prior Art)
Figure 3E:
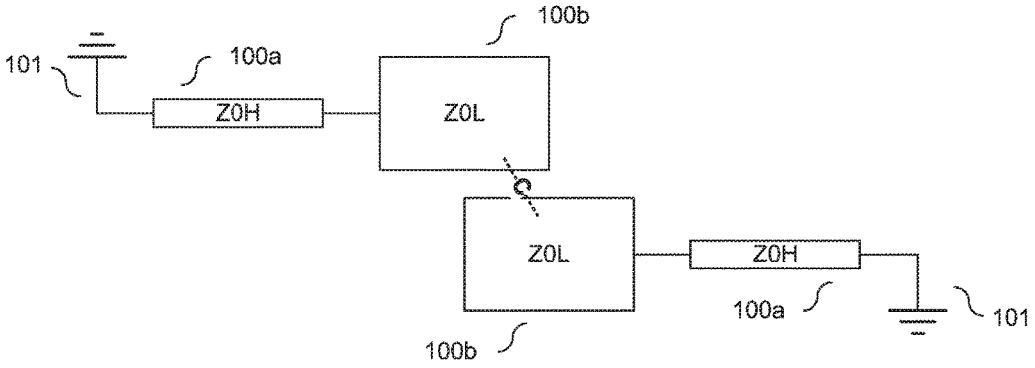
Fig. 3e (Prior Art)
Figure 4A:
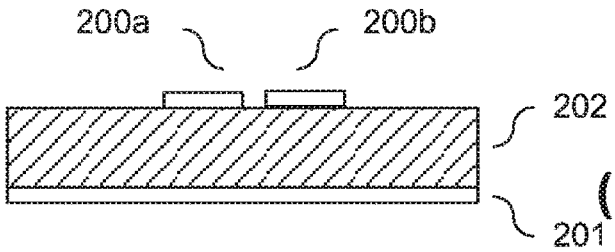
Fig 4a (Prior Art)
FIGS. 4*a*-4*c* illustrate coupling between physical transmission line structures, in accordance with prior art examples disclosed herein.
Figure 4B:
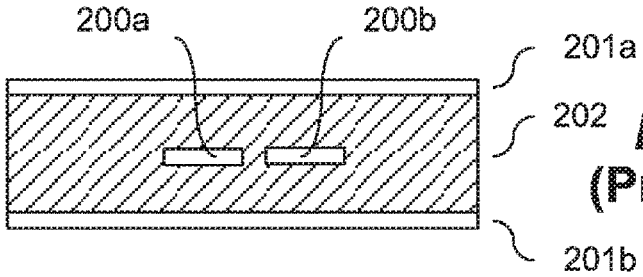
Fig. 4b (Prior Art)
Figure 4C:
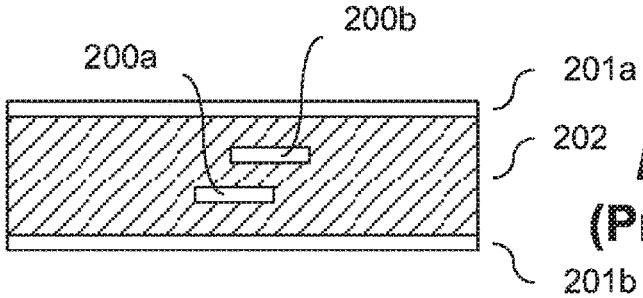
Fig. 4c (Prior Art)

The present invention relates to radio frequency filters and related structures, such as diplexers, multiplexers, implemented with multilayer metallic-dielectric structures, such as multilayer printed circuit boards (PCB), low-temperature co-fired ceramics (LTCC) structures, and integrated circuits.

According to a first embodiment there is provided a filter comprising a multilayer dielectric structure (e.g. PCB or a ceramic structure) with conducting material such as metal disposed between the dielectric layers so that resonator carrying layers also serve as groundplanes for resonators in adjacent layers. In this manner the number of resonators is increased, since all or nearly all the layers carry resonating structures, so that filters with higher number of poles are therefore provided.

According to a second aspect, methods are provided to implement radio frequency filters in multilayer metallic-dielectric structures, such as printed circuit boards (PCB), low temperature co-fired ceramic (LTCC) components and integrated circuits (IC). The methods utilize for example vertical stacking of transmission lines and related frequency-selective structures to obtain compact implementation of filters of high order. The methods are applicable to filters and related structures such as multiplexers.

According to a third aspect there is provided a resonator, which may be of either quarter-wavelength short-open resonators, or half-wavelength open-open or short-short resonators, or stepped impedance resonators.

The use of vertically stacked stripline structure allows very compact implementation of the filters. However, since each of the layers carries a resonator, and resonators are in a proximity to each other, means are needed to control the coupling between the resonators so that the coupling is not excessive. Additionally, there's a need to control the coupling between the nonadjacent resonators, so that no unwanted transmission zeros are introduced. Therefore, another aspect of the invention is the manner in which the coupling between the resonators is realized. According to embodiments, the stripline resonators are surrounded not only by groundplanes below and above the resonators, but also by groundplane on the sides of it, as in coplanar waveguide (CPW) structures. By this, the coupling between structures in adjacent layers is reduced and the coupling between nonadjacent layers is reduced even more due to the shielding effect of the groundplane on the sides.

The use of resonators in adjacent layers, which serve also as stripline groundplanes for each other, allows variety of coupling mechanisms. Proximity between the ends of transmission lines shorted to ground creates predominantly inductive coupling. Proximity between the open ends of transmission lines creates predominantly capacitive coupling. Use of both types of coupling in filters allows balancing the filter skirt slopes above and below the passband.

The proposed filter configuration allows the following advantages:

- More compact realization of filters for a given PCB area;
- Increased order of the filter while maintaining low parasitic coupling;
- Reduced use of PCB vias in the signal path;
- Very low radiation and isolation degradation due to signal shielding in the stripline; and
- Realizing filters which have ports on opposite sides of the PCB.

Figure 5A:
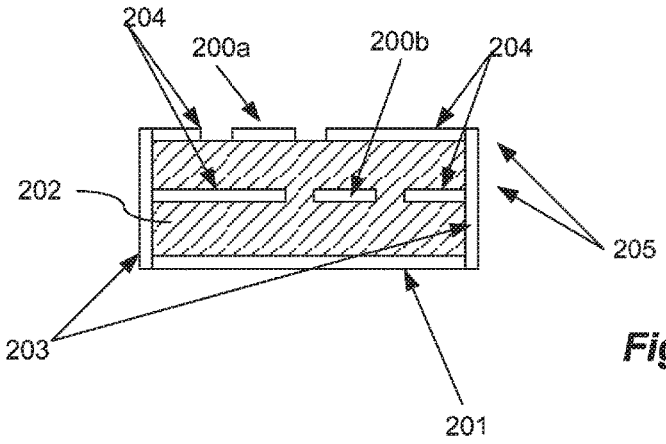
FIGS. 5*a*-5*c* illustrate coupling between CPW physical transmission line structures, in accordance with examples disclosed herein.
Figure 5B:
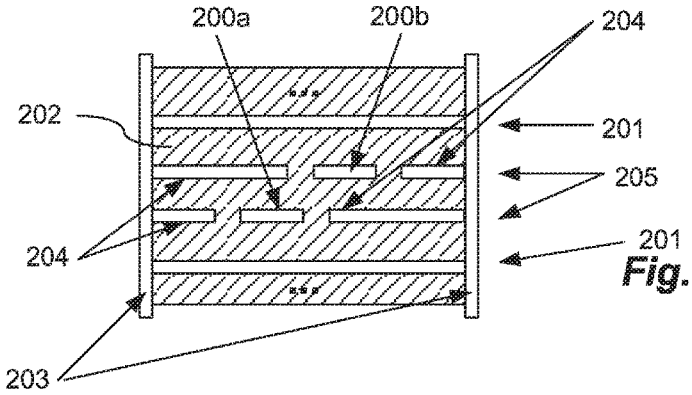
Figure 5C:
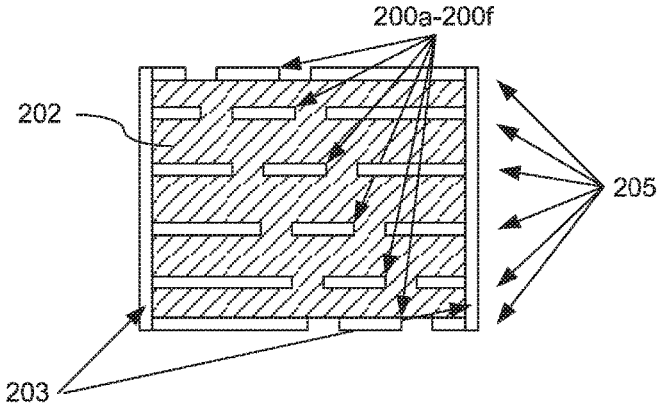

Reference is now made to FIGS. 5*a*-5*c* illustrating coupling between CPW physical transmission line structures, in accordance with embodiments. FIG. 5*a* shows a singly-grounded CPW 200*a* in the top layer, with a doubly grounded CPW 200*b* below it. The proximity between lines 200*a* and 200*b* generates the coupling. Strictly speaking, the lines 200*a* are not grounded CPW lines in the regular sense, since the adjacent layer is not a contiguous groundplane, but rather a ground component 204 of a CPW-carrying layer 205. Nevertheless, this partial ground has an important effect as will be discussed later. FIG. 5*b* illustrates another embodiment with two doubly-grounded CPW lines in the inner layers. Finally, FIG. 5*c* illustrates another embodiment where extended to multiple CPW lines in different adjacent layers of a multilayer PCB. In this case, the top-layer line 200*a* is coupled primarily to the line 200*b* in the next layer, and so on, ending at the line 200*f* in the bottom layer, which is coupled primarily to the line 200*e* in the previous layer. Nonadjacent lines have low coupling, due to the presence of groundplane surfaces in each CPW layer. The groundplanes are kept at same potential by sidewalls 203, as discussed before.

FIGS. 6*a-c*, 7*a-c* and 8*a-c* is a top view and a side view accordingly illustrating the application of grounded CPW structures to coupled resonators according to some embodiments. The stepped impedance CPW resonators in adjacent layers are coupled by proximity of their inductive sections 200*a* and 200*b*. Note that the capacitive sections 200*c* and

Figure 6A:
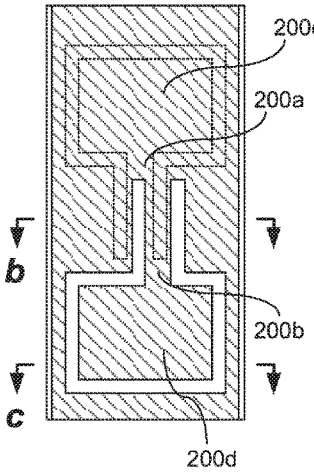
FIGS. 6*a-c*, 7*a-c* and 8*a-c* illustrate an application of grounded CPW structures to coupled resonators in accordance with examples disclosed herein.
Figure 7A:
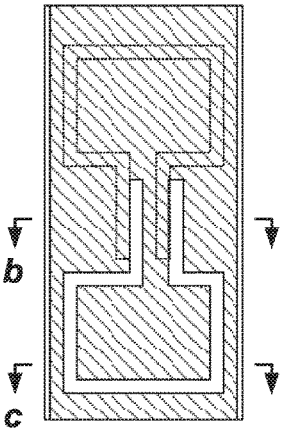
Figure 8A:
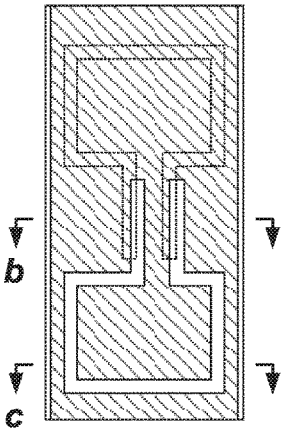
Figure 6B:
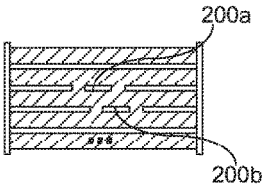
Figure 7B:
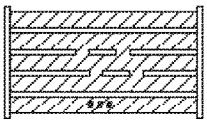
Figure 8B:
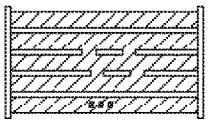
Figure 6C:
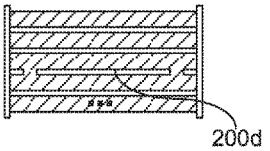
Figure 7C:
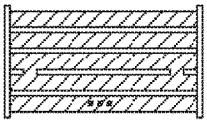
Figure 8C:
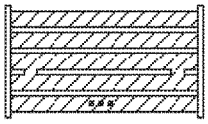

200*d* are surrounded by contiguous groundplanes and thus are well shielded, as seen in the cuts FIGS. 6*c*, 7*c* and 8*c*. The embodiments shown in FIGS. 6*a-c*, 7*a-c* and 8*a-c* differ by the amount of coupling between the inductive sections. FIG. 6*a-c* shows the weakest coupling, as seen from the large stagger between the lines 200*a* and 200*b* in FIG. 6*b*. FIG. 8*a-c* shows the tightest coupling, as seen from the larger overlap between the signal lines in FIG. 8*b*.

Figure 9:
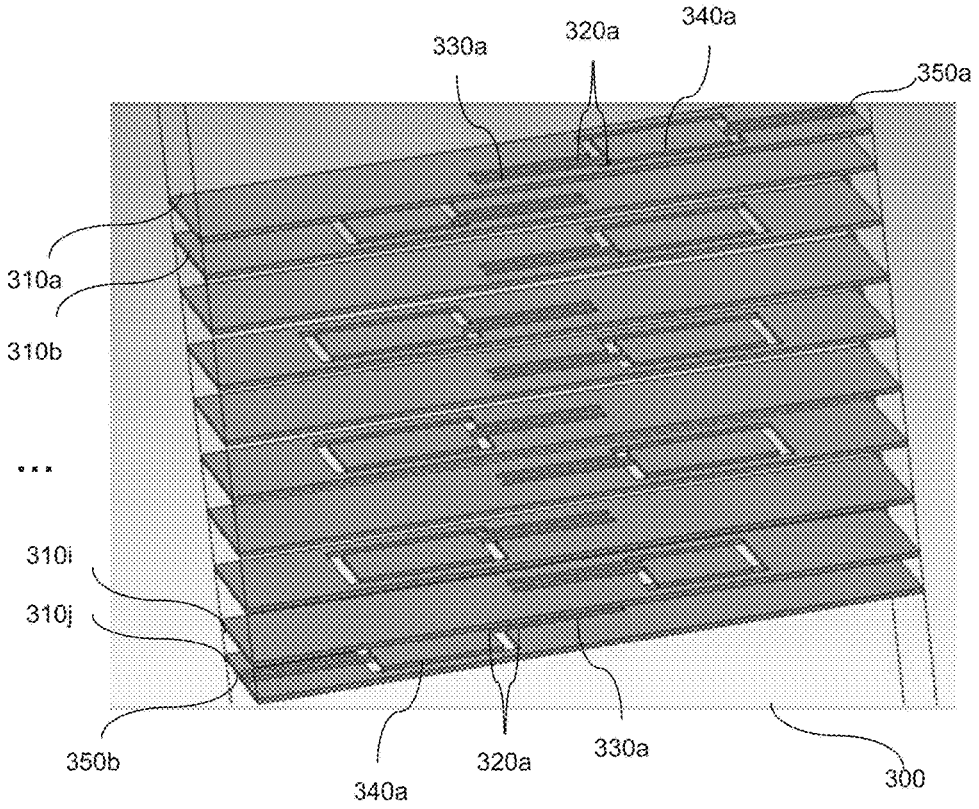
FIG. 9 illustrates a three dimensional upper-side view of a multilayer filter implemented on a multi-layer circuit, in accordance with examples disclosed herein.

Reference is now made to FIG. 9 which is a three dimensional upper-side view of a multilayer filter 300 implemented on a multi-layer circuit, in accordance with embodiments. For clarity and to better illustrate the structure of the filter, the vertical scale of the multilayer circuit is exaggerated. In this embodiment, the structure is a ten-layer circuit where each circuit's layers 310*a*-310*j* includes, respectively, frequency selective components (e.g. resonators) 320*a*-320*j* structured as a grounded CPW circuit for filtering a signal. The space between the layers may be filled with a dielectric laminate material, such as a FR-4 glass-epoxy or Teflon, for isolating the layers and defining a dielectric constant.

Specifically, the resonators 320*a*-320*j* are designed as stepped impedance resonators where for example each of the filter's layers comprise, a narrow (e.g. inductive) line section 330 and a wide (e.g. capacitive) line section 340 for forming a stepped impedance resonator (SIR) structure at each layer. According to some embodiments, the directions of the SIRs are inverted at each layer, so that the inductive sections 330 overlap, while the capacitive sections 340 are either far from each other or shielded from each other by the groundplanes. As mentioned hereinabove the resonators 320*a*-320*j* are surrounded not only by groundplanes below and above the resonators (e.g. between the layers), but also by groundplane on the sides, forming effectively grounded CPW structure. By this the coupling between structures in adjacent layers is reduced, and the coupling between nonadjacent layers is reduced even more due to the shielding effect of the groundplane on the sides.

As shown in FIG. 9 in accordance with embodiments there is provided a filter comprising a plurality of conducting layers, and a plurality of frequency selective components. Each conducting layer of at least two layers of the plurality of conducting layers comprises at least one frequency selective component and a groundplane. In embodiments the groundplane surrounding the at least one frequency selective component. Additionally, the at least one frequency selective component in a first layer and the at least one frequency selective component in a second layer of the at least two layers or the plurality of conducting layers overlap with one another. In some embodiments the layers partially or completely overlap with one another in at least one dimention.

In an exemplary embodiment the ten layers of the filter 300 may be, respectively, of thickness 4-6-6-6-6-6-6-6-6-4 mil (where mil stands for a thousandth of an inch, 0.0254 mm), and the overall thickness of the filter circuit 300, is the common PCB thickness of 1.6 mm (62 mil) size. Other embodiments may include one or more different thickness ranges.

According to one embodiment, the narrow sections 330 in each layer may be situated in the middle of the filter in parallel to one another while, the wide sections 340 are at the ends of the filter, so that in adjacent layers the ends alternate. According to some embodiments, same linewidth is used in all the layers for the narrow and wide (capacitive) line sections.

In the exemplary embodiment shown here, a first port (e.g. input port) and a second port (e.g. output port) feed lines 350*a* and 350*b* are situated at the top and the bottom layer of the PCB. Specifically, the input port may be placed at the outermost layer and the output port at the outermost opposite layer. In some cases, the design can be altered so that the input and output are on the same side, or are in the inner layers.

According to one embodiment, the inductive lines 330 may be around 0.2 mm wide, while the capacitive line 340 may be around 1.4 mm wide. The length of both may be about 2 mm, for a 4-6 GHz passband. The width of the filter structure 300 may be around 2.5 mm, and its overall length is about 8 mm.

The characteristic impedance of each transmission line (e.g. stripline or CPW) depends on linewidth, the thickness of the surrounding dielectric layers and their dielectric constant. For most of the resonators in this exemplary design the thickness is 6+6 mil, and the resonators are similarly sized. However, the second and the ninth layers are 4+6 mils thick, and as a result the resonator proportions are slightly different. Similarly, the outermost resonators are may be microstrip lines on a 4 mil substrate, since on the outer side there's air rather than an additional substrate. This incurs yet another change in resonator proportions. These changes are accounted for by the electromagnetic analysis and optimization software used to finalize the resonator dimensions and the stagger between the coupled sections of the resonators.

The coupling between the adjacent resonators is primarily inductive. The amount of coupling depends on the length and on the stagger between the inductive sections 330*a*-330*j* of the resonators. In a specific design example, all the inductive sections 330 are of same length and same overlap length.

According to some embodiments, along the edges of the filter 300 electric walls are placed, implemented as a dense chain of through vias (not shown in the drawing).

Figure 10A:
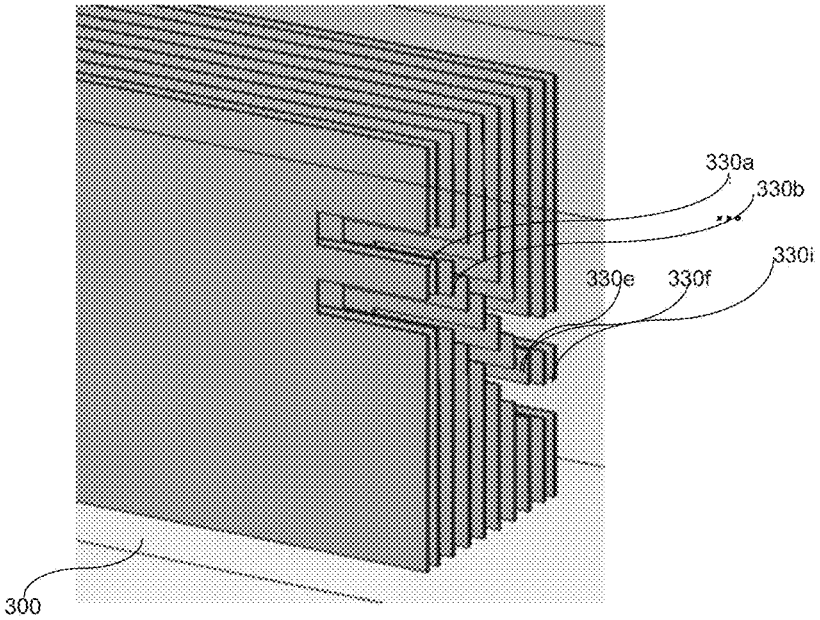
FIGS. 10*a*-10*b* illustrate a cut view of a 10-pole filter, in accordance with examples disclosed herein.

FIG. 10*a* is a three dimensional cross-sectional view of the filter, crossed around the middle of the structure 300 at the narrow (e.g. inductive) line sections 330, illustrating the varying coupling as implemented by the amount of stagger of the resonators. For example, lines 330*a* and 330*b* are strongly coupled, while the middle sections 330*e* and 330*f* are staggered and thus more loosely coupled. This situation of strong coupling at the outer resonators and weaker coupling at the middle resonators is typical of Butterworth and Chebyshev filters.

Figure 10B:
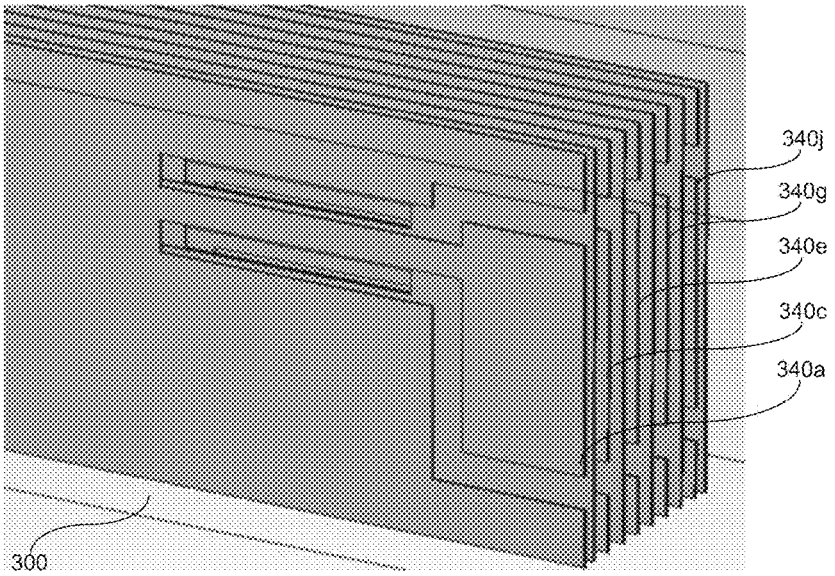

As illustrated in FIG. 10*b* the capacitive lines 340 are not staggered, as they are separated by groundplanes.

Figure 11:
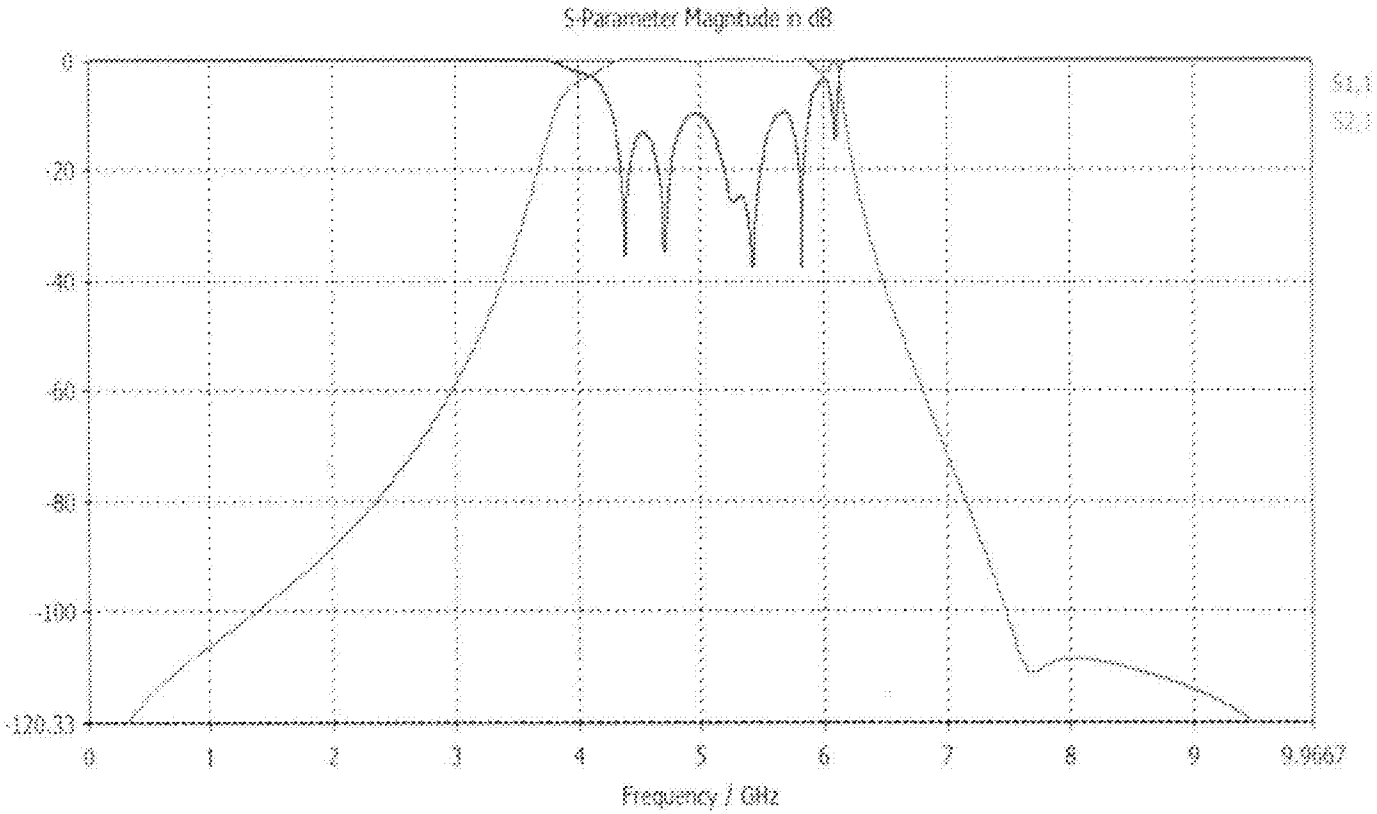
FIG. 11 illustrates a simulated response of the 10-layer filter, in accordance with examples disclosed herein.

FIG. 11 shows an exemplary response of the filter, as analyzed, in this instance, by CST (Computer Simulation Technology) electromagnetic analysis software. Naturally, any other applicable electromagnetic analysis software can be used for this purpose.

The passband of the filter is approximately 4 GHz to 6 GHz, with very sharp out-of-band fall-off. The falloff is sharper above the passband than below the passband—this may be attributed to the inductive coupling and to transmission zeros. The effective order of the filter according to the nulls in the S11 reflection coefficient is more like 8, rather than 10. This is related to the very tight coupling of the feed lines to the outermost resonators. The outermost resonators are primarily used to couple more effectively the incoming energy to the next resonators, rather than to act as filtering components.

The filter design described above was scaled to different center frequencies, ranging from ~1 GHz to ~16 GHz. In this example, the application in mind was to obtain a channelizing filter bank. The scaling was performed by scaling the lengths of the resonators and the overlap lengths proportionately. As the lateral offsets between the resonators, which govern the coupling factors, were kept same, it was anticipated that the filter shape will scale in frequency, and will keep same relative bandwidth. The filters were implemented with FR-4 material, having a dielectric constant of about 3.5. The reference parameter of 2 mm length of the inductive and capacitive section was scaled to lengths of 10 mm, 8 mm, 5.6 mm, 4 mm, 2.8 mm, 2 mm, 1.4 mm, 1 mm, 0.7 mm, 0.5 mm, and 0.35 mm respectively.

Figure 12:
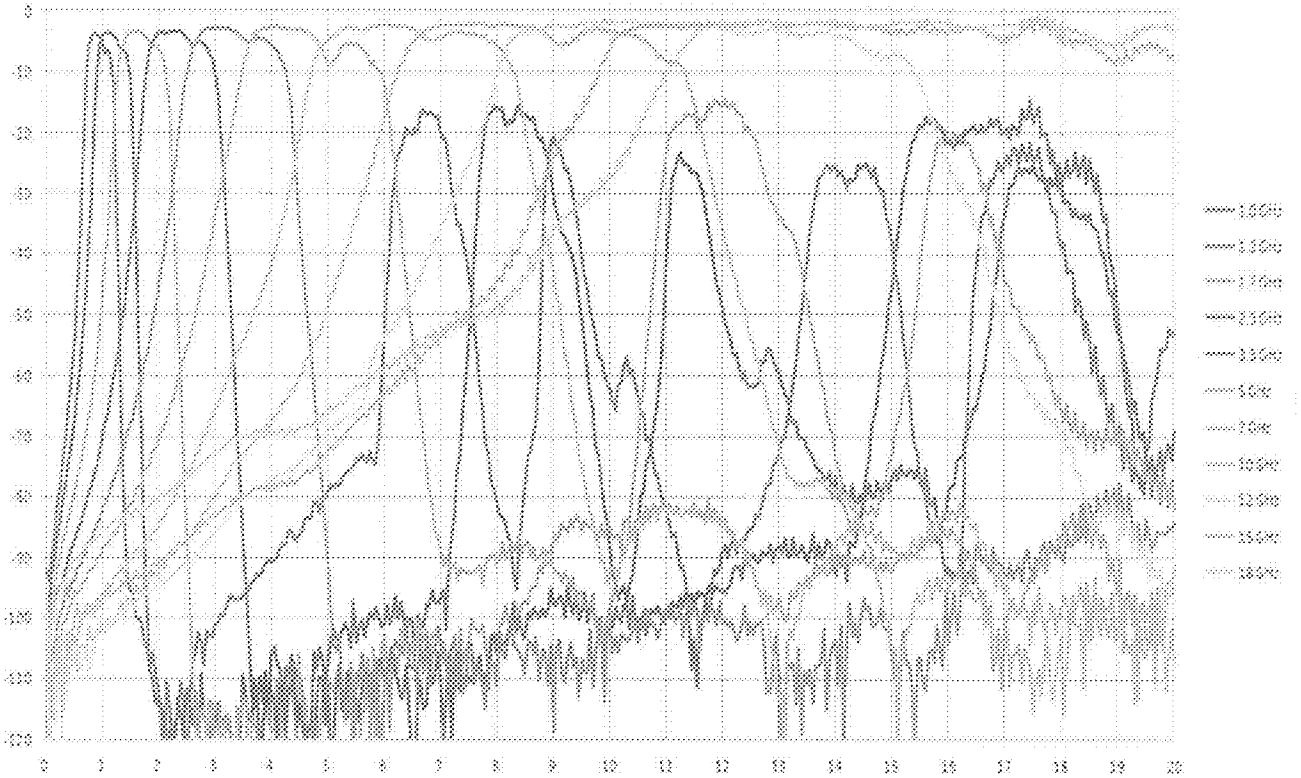
FIG. 12 illustrates measured response of the designed filter and several scaled versions of it on a linear frequency scale, in accordance with examples disclosed herein.
Figure 13:
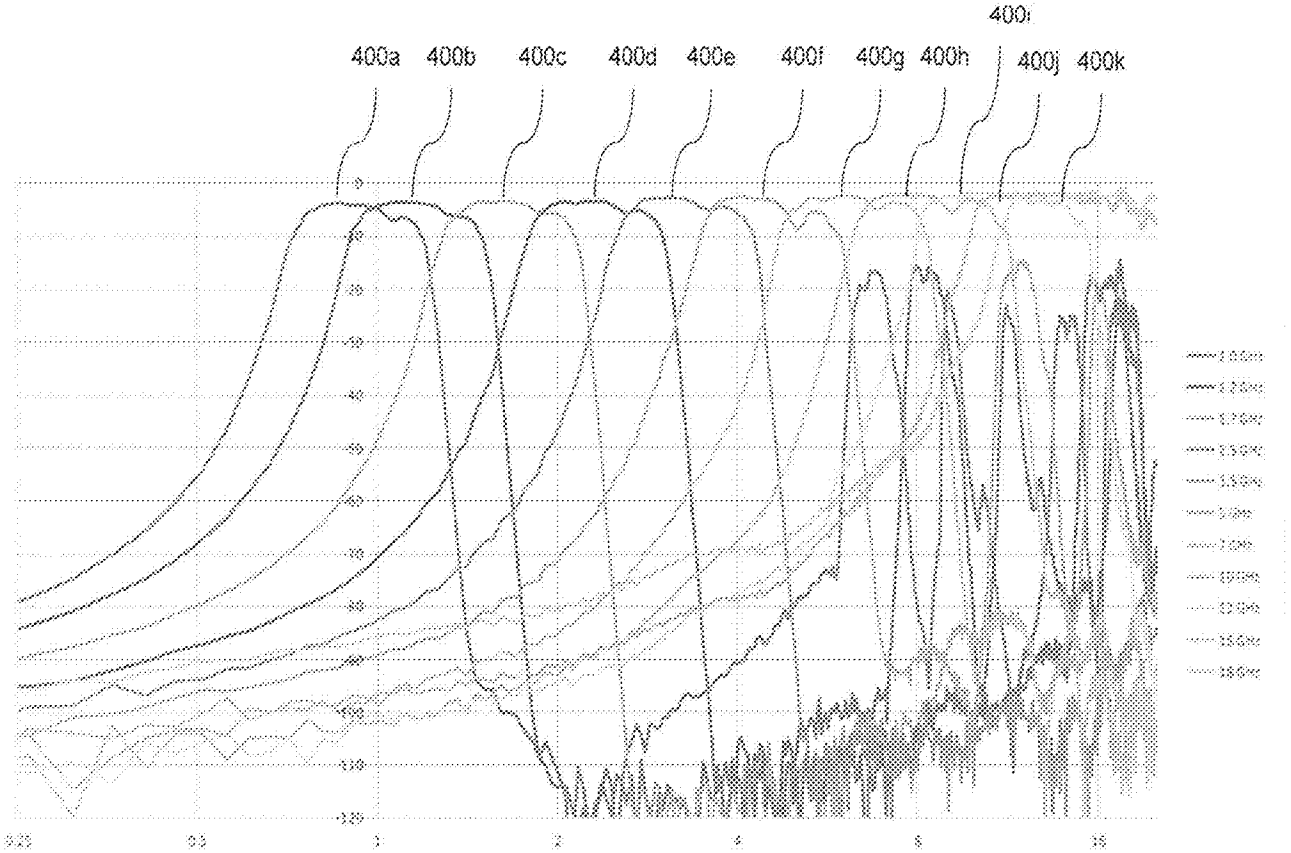
FIG. 13 illustrates measured response of the designed filter and several scaled versions of it on a logarithmic frequency scale, in accordance with examples disclosed herein.

FIGS. 12 and 13 show the measured responses (up to 20 GHz) of 11 filters on a linear frequency scale and on a logarithmic frequency scale.

The log-log plot shows that the filters scale extremely well in terms of passband shape, with some variation in the stopband response, as it gets to below −70 dB. The filters at the highest bands deviate from the exact scaling, as the length of 0.35-0.5 mm becomes commensurate with the linewidth and gaps of 0.2 mm, and it is smaller than the capacitive section linewidth 0f 1.4 mm. Nevertheless, these filters still perform very well in terms of their shape.

A possible advantage of the filter structure in accordance with embodiments is to embed a filter into a printed circuit board in a manner that the input port is on one side of the PCB, while the output port is on the other side, as was done in the design example shown above. This topology reduces the direct leakage between the filter input and output, allowing very high level of stopband isolation. In the specific exemplary implementation, stopband levels well above 100 dB were seen.

Yet another observation regarding the exemplary design shown herein (e.g. FIG. 9) is that the use of stepped impedance resonators has pushed the spurious upper passband to six times the desired passband frequency, as opposed to three times in regular quarterwave resonators.

While embodiments illustrated herein were described in context of multilayer printed circuits, a person of ordinary skill in the art will recognize numerous variations based on the teachings described herein. For example the embodiments may be applied to other multilayer structures, for example to LTCC (low temperature co-fired ceramic) technology, and to integrated circuits with multiple metallization layers.

Additionally, the resonators in accordance with embodiments were described in terms of transmission lines and combinations of transmission lines. However, these resonators can be generalized to contain other elements such as capacitive radial stubs, multilayer capacitors, and meandered of coiled printed lines exploiting the mutual inductance between line segments.

Moreover, embodiments may be applied to other filter types, such as bandstop, highpass etc. by implementing the resonators, the inductive and the capacitive elements of the filters in the multiple layers, as described. Furthermore, embodiments apply to filter banks, duplexers, multiplexers and related structures.

It is stressed that the term "overlap", throughout the description and the claims, means either partial overlap between elements or full overlap. Moreover, the term "overlap" refers to overlap in the two-dimensional plane of the layers, while the elements may be staggered in the third direction due to belonging to different layers.

The terms "comprises", "comprising", "includes", "including", "having" and their conjugates mean "including but not limited to". This term encompasses the terms "consisting of" and "consisting essentially of".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the detailed description contains many specifics, these should not be construed as limiting the scope of the disclosure but merely as illustrating different examples and aspects of the present disclosure. It should be appreciated that the scope of the disclosure includes other embodiments not discussed in detail above. Various other modifications, changes and variations which will be apparent to those skilled in the art may be made in the arrangement, operation and details of the method and apparatus of the present disclosure provided herein without departing from the spirit and scope of the invention as described herein.

While preferred embodiments of the present disclosure have been shown and described herein, it will be obvious to those skilled in the art that such embodiments are provided by way of example only. Numerous variations, changes, and substitutions will be apparent to those skilled in the art without departing from the scope of the present disclosure. It should be understood that various alternatives to the embodiments of the present disclosure described herein may be employed without departing from the scope of the present invention. Therefore, the scope of the present invention shall be defined solely by the scope of the appended claims and the equivalents thereof.

What is claimed is:

1. A filter, comprising:

a plurality of conducting layers, said plurality of conducting layers comprise at least three adjacent conducting layers, wherein each conducting layer of the at least three adjacent conducting layers comprises:

at least one frequency selective component and a groundplane, wherein said groundplane surrounds said at least one frequency selective component; and wherein the at least one frequency selective component in at least one layer is coupled by proximity to the at least one frequency selective component in each of two adjacent layers.

2. The filter of claim 1, wherein each of the at least one frequency selective components comprises a structure selected from the group comprising of:

stripline, microstrip, coplanar waveguide, singly-grounded coplanar waveguide, and doubly-grounded coplanar waveguide.

3. The filter of claim 1, wherein the said plurality of conducting layers comprises a structure elected from the group consisting of:

a printed circuit structure, ceramic structure, LTCC (low temperature co-fired ceramics) structure, integrated circuit structure.

4. The filter of claim 1, wherein at least one of said at least one frequency selective components is a stepped impedance resonator.

5. The filter of claim 1, wherein said plurality of conducting layers comprises at least four adjacent conducting layers.

6. The filter of claim 5, wherein the at least one frequency selective component in the at least two layers is coupled by proximity to at least one frequency selective component in each of two adjacent layers.

7. The filter of claim 1, wherein the groundplanes of each of said at least three adjacent conducting layers are interconnected by multiple through vias surrounding each of the at least one frequency selective components.

8. The filter of claim 1, wherein said plurality of conducting layers comprises at least six adjacent conducting layers.

9. The filter of claim 8, wherein the at least one frequency selective component in the at least four layers is coupled by proximity to at least one frequency selective component in each of two adjacent layers.

10. A filter comprising:

at least two groups conducting layers, each group comprising at least two adjacent conducting layers, wherein each conducting layer of said groups comprises:

at least one frequency selective component and a groundplane, wherein said groundplane surrounding said at least one frequency selective component; and wherein the at least one frequency selective component in each two adjacent layers of said group are coupled by proximity.

* * * * *